United States Patent [19]

Pfaffle

[11] 4,129,913

[45] Dec. 19, 1978

[54] ARRANGEMENT FOR PERFORATING AND SPIRAL BINDING OF RELATIVELY THICK GROUPS OF SHEETS

[75] Inventor: Ernst Pfaffle, Neuffen, Germany

[73] Assignee: Hans Sickinger Co., Pontiac, Mich.

[21] Appl. No.: 823,633

[22] Filed: Aug. 11, 1977

[51] Int. Cl.[2] ..... B42C 19/08

[52] U.S. Cl. ..... 11/1 A; 140/92.3; 140/92.7

[58] Field of Search ..... 11/1 A, 1 R, 1 AC; 140/92.3, 92.7

[56] References Cited

U.S. PATENT DOCUMENTS

| | | | |
|---|---|---|---|
| 2,973,199 | 2/1961 | Biel et al. | 11/1 R |
| 3,826,290 | 7/1974 | Pfaffle | 140/92.7 |
| 4,041,883 | 8/1977 | Meratti | 11/1 A |

*Primary Examiner*—Donald R. Schran

*Attorney, Agent, or Firm*—Harness, Dickey & Pierce

[57] ABSTRACT

A system for perforating the edges and then spiral binding relatively thick books at a rapid rate. The system overcomes the relative difficulty of perforating, as compared with spiral binding, thick books by splitting the path for the perforating step into two paths and perforating simultaneously on both paths. The perforated books are then placed on a transverse leg of the system so that they combine into a single row which is fed to the spiral binder.

2 Claims, 1 Drawing Figure

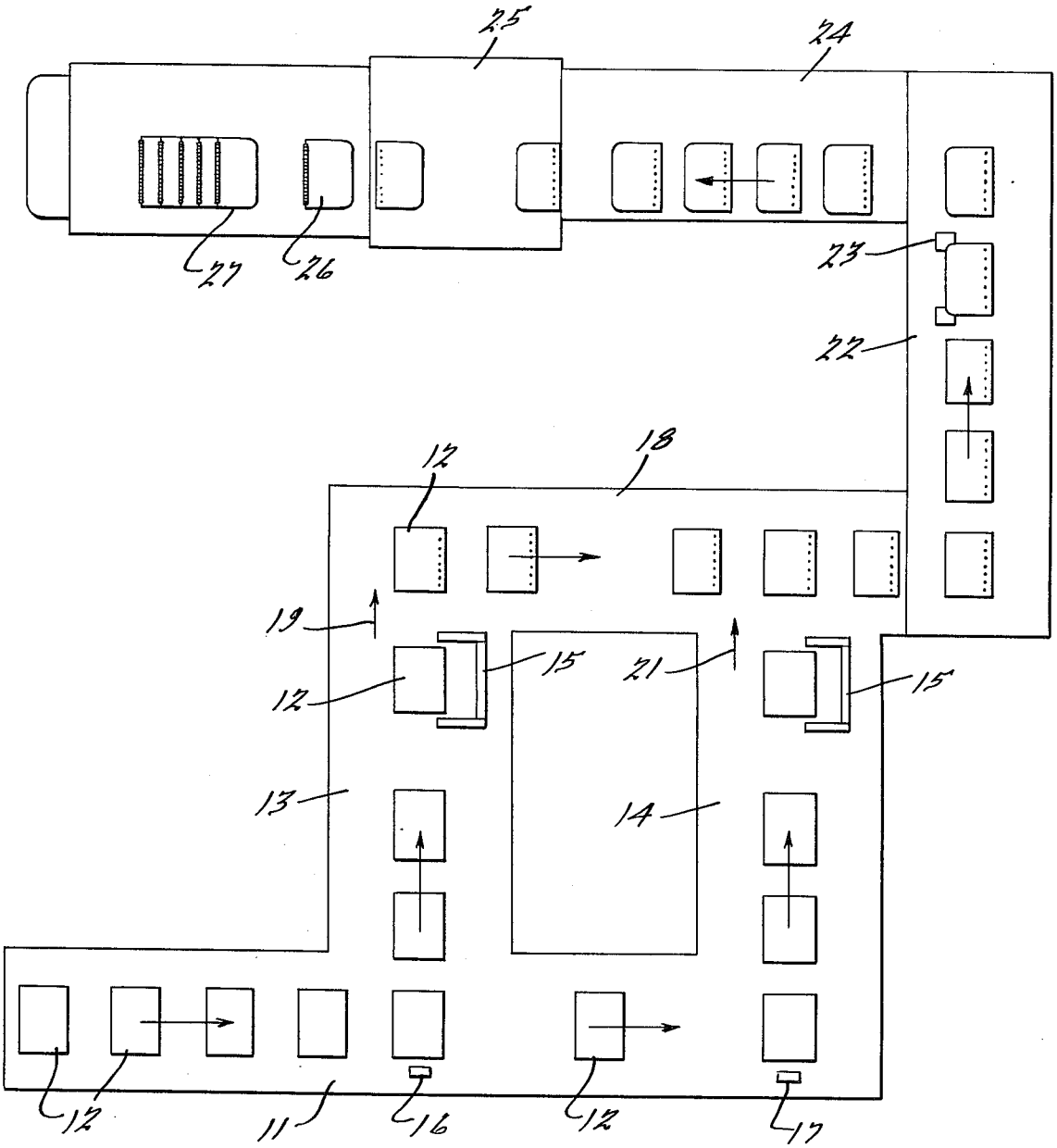
25
24
27
26
23
22
12
18
19
12
15
21
15
13
14
12
11
16
12
17

ARRANGEMENT FOR PERFORATING AND SPIRAL BINDING OF RELATIVELY THICK GROUPS OF SHEETS

BACKGROUND OF THE INVENTION

1. Field of the Invention

The invention relates to machines for manufacturing spiral wire bound books or pads on a production basis. A machine of this general type is shown, for example, in Biel et al U.S. Pat. No. 2,973,199.The present invention is concerned primarily with the steps of perforating the book edges and spiral binding the perforated groups. More particularly, the invention is intended to handle relatively thick groups of sheets.

2. Description of the Prior Art

Conventionally, groups of sheets are first perforated along their edges, for example, by a machine such as that shown in Pfaffle, U.S. Pat. No. 3,739,672, and are then fed to a coil binding machine such as shown in Pfaffle U.S. Pat. No. 3,826,290 where they are spiral bound. The conventional manner of handling sheets in these machines is to feed them serially in a single line.

With thicker books, a spiral binding machine such as that shown in U.S. Pat. No. 3,826,290 can bind a substantially greater number of books in a given space of time than the conventional perforating machine can handle. The result is that the production rate can be no greater than the rate at which the perforating machine, whether it be a drilling or punching apparatus, can handle these particular books.

BRIEF SUMMARY OF THE INVENTION

It is an object of the present invention to provide a novel and improved system for overcoming the above described diffulties in the preparation of relatively thick books, so that the production rate can be substantially increased.

Briefly, the perforating and coil binding system of this invention comprises a first leg along which groups of sheets are moved with a predetermined spacing, first and second perforating station legs extending transversely from said first leg and spaced from each other, means for shifting alternate books onto the first of said perforating station legs and the remaining books onto said second perforating station leg, said two perforating station legs having means for perforating said groups, a receiving leg extending past the exit ends of said two perforating station legs, means for alternately placing perforated groups from said first and second perforating station legs onto said receiving leg whereby the perforated groups form a single line, a coil binding station spaced from said receiving leg, and means for transporting said single line of perforated groups to said coil binding station.

BRIEF DESCRIPTION OF THE DRAWING

The FIGURE is schematic view showing the system of this invention.

DESCRIPTION OF THE PREFERRED EMBODIMENT

The system is provided with a first leg 11 along which a series of spaced groups of sheets 12 are fed in spaced relation. These groups, for example, comprise pads having covers and sheets therebetwen. First and second perforating station legs 13 and 14 are provided which extend at right angles from leg 11. As shown, leg 13 is upstream and leg 14 downstream, the legs being in spaced parellel relation. Each leg is provided with a perforating mechanism 15 such as a punching or drilling apparatus.

Means 16 are provided for diverting alternate books 12 from leg 11 onto leg 13. The remaining books 12 pass downstream to leg 14 where means 17 diverts them onto leg 14.

Books are simultaneously perforated on two separate legs 13 and 14. The system thus perforates books at twice the rate which would ordinarily take place. The perforated books are fed from both legs 13 and 14 unto a receiving leg 18 extending parallel to leg 11 past the exits of leg 13 and 14. Means 19 are provided for feeding the perforated books 12 from leg 13 unto leg 18, and synchronized means 21 provided for feeding the perforated books from leg 14 into the spaces between books coming from leg 13. The books are thus again arranged in single file and are fed to an intermediate leg 22 extending from the end of leg 18 parallel to legs 13 and 14. On leg 22 means 23 may be provided for corner trimming the perforated sheet piles.

The groups are then fed to a leg 24 and into a spiral wire binding machine 25 which may be of the aforesaid type. This machine is capable of binding a relatively thick book at a much faster rate than it can be perforated by a single perforating machine. The bound books 26 are then stacked at a station 27.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A perforating and coil binding system for relatively thick groups of sheets, comprising a first leg along which groups of sheets are moved with a predetermined spacing, first and second perforating station legs extending transversely from said first leg and spaced from each other along said first leg, means for shifting alternate groups from said first leg onto the first of said perforating station legs and the remaining groups onto said second perforating station leg, said two perforating station legs having means for perforating said groups, a receiving leg extending transversely past the exit ends of said two perforating station legs with said first perforating station leg being upstream of said second perforating station leg, means for alternately placing perforated groups from said first and second perforating station legs onto said receiving leg whereby the perforated groups form a single line, said last-mentioned means including means for feeding the perforated groups from said first perforating station leg, in spaced relation, onto said receiving leg and synchronized means for feeding the perforated groups from said second perforating station leg into the spaces between groups coming from said first perforating station leg, a coil binding station spaced from said receiving leg, and means for transporting said single line of perforated groups to said coil binding station.

2. A system according to claim 1, said last-mentioned means comprising a transverse leg leading from the exit end of said receiving leg, and a coil binder leg leading from the exit end of said transverse leg.

* * * * *